US006695144B2

(12) United States Patent
Freeze

(10) Patent No.: US 6,695,144 B2
(45) Date of Patent: Feb. 24, 2004

(54) CARTON WITH EXTENDED PANEL

(75) Inventor: Timothy E. Freeze, Mebane, NC (US)

(73) Assignee: MPC Packaging Corp., Mebane, NC (US)

( * ) Notice: Subject to any disclaimer, the term of this patent is extended or adjusted under 35 U.S.C. 154(b) by 79 days.

(21) Appl. No.: 10/075,887

(22) Filed: Feb. 14, 2002

(65) Prior Publication Data

US 2002/0070146 A1 Jun. 13, 2002

Related U.S. Application Data

(63) Continuation-in-part of application No. 09/543,129, filed on Apr. 5, 2000.

(51) Int. Cl.[7] ..... B65D 25/00
(52) U.S. Cl. ..... 206/768; 206/459.5
(58) Field of Search ..... 206/768, 806, 206/459.5, 831; 229/122.2, 149, 153, 228, 212

(56) References Cited

U.S. PATENT DOCUMENTS

| | | | | | |
|---|---|---|---|---|---|
| 945,349 | A | * | 1/1910 | Tatham | 206/459.5 |
| 2,359,679 | A | * | 10/1944 | Roehrl | 206/459.5 |
| 3,099,381 | A | | 7/1963 | Meyers | |
| 3,214,075 | A | * | 10/1965 | Champlin et al. | 206/831 |
| 3,219,253 | A | * | 11/1965 | Davis | 206/831 |
| 3,329,331 | A | | 7/1967 | Morgan | |
| 3,335,937 | A | | 8/1967 | Kramer | |
| 3,556,388 | A | | 1/1971 | Klein | |
| 3,814,303 | A | * | 6/1974 | Smith | 206/806 |
| 3,827,625 | A | | 8/1974 | Miller | |
| 3,946,936 | A | * | 3/1976 | Brown | 206/806 |
| 4,108,350 | A | | 8/1978 | Forbes, Jr. | |
| 4,245,772 | A | | 1/1981 | Johnson | |
| 4,266,671 | A | * | 5/1981 | Roccaforte | 206/806 |
| 4,279,376 | A | * | 7/1981 | Roccaforte | 206/806 |
| 4,291,807 | A | * | 9/1981 | Giordano et al. | 206/470 |
| 4,308,986 | A | * | 1/1982 | Parrilli | 206/806 |
| 4,320,830 | A | | 3/1982 | Roccaforte | |
| 4,331,240 | A | * | 5/1982 | Vanasse | 206/806 |
| 4,333,602 | A | | 6/1982 | Geschwender | |
| 4,344,533 | A | | 8/1982 | Olsen | |
| 4,360,106 | A | * | 11/1982 | Irvine et al. | 206/806 |
| 4,867,372 | A | * | 9/1989 | Patterson | 206/521 |
| 4,872,555 | A | | 10/1989 | Shadrach, III et al. | |
| 4,949,845 | A | | 8/1990 | Dixon | |
| 5,222,657 | A | | 6/1993 | Holland, Jr. | |
| 5,242,055 | A | | 9/1993 | Pora | |
| 5,248,032 | A | * | 9/1993 | Sheu et al. | 206/312 |
| 5,341,923 | A | * | 8/1994 | Arasim | 206/214 |
| 5,566,831 | A | * | 10/1996 | Swenson | 206/806 |
| 5,655,707 | A | | 8/1997 | Jensen | |
| 5,665,439 | A | * | 9/1997 | Andersen et al. | 206/449 |
| 5,690,273 | A | | 11/1997 | Jensen | |
| 5,836,451 | A | | 11/1998 | Dixon | |
| 5,866,183 | A | | 2/1999 | Small | |

* cited by examiner

*Primary Examiner*—Shian Luong
(74) *Attorney, Agent, or Firm*—Womble Carlyle Sandridge & Rice, PLLC

(57) ABSTRACT

A carton for packaging articles, having an extended panel hingedly connected to one of the side panels. The extended panel is releasably adhered to the adjacent front or rear wall panel.

5 Claims, 4 Drawing Sheets

CARTON WITH EXTENDED PANEL

RELATED APPLICATIONS

This application is a continuation-in-part of allowed application Ser. No. 09/543,129, filed Apr. 5, 2000, which is in issue.

BACKGROUND OF THE INVENTION

The present invention relates generally to folding cartons and, more particularly, to a folding carton having an extended exterior panel providing additional space for the printing of indicia thereon.

For many years, manufacturers have packaged products of many types and sizes in paperboard cartons. For items manufactured and packaged for resale, manufacturers often utilize the surfaces of the cartons for distinctive, catchy advertising, intended to induce consumers to purchase the product. As consumer product and product liability standards have evolved in recent decades, manufacturers have been required to print increasing amounts of consumer protection information directly on the outside of cartons, or in the alternative, on paper inserts placed in the cartons with the product. Further, many regulatory warnings are now required to be of a particular type or size. This has increased the need for printing area, whether on the outside of cartons or on the paper inserts packaged with the product. While printed paper inserts are relatively inexpensive to produce, considerable difficulty is involved in folding the inserts and placing them in the cartons. Also, paper inserts cannot be inspected at the retailer, and quite often, after purchase consumers never remove the inserts from the cartons or simply discard them.

The prior art discloses a carton having an additional panel directed to providing more printing area than conventional four-sided cartons. However, once opened, the additional panel may not be reattached and the carton cannot be returned to its original configuration. There is known a one-piece carton having an integral coupon card that may be detached from the carton along a perforated line, but the construction of the carton and coupon is not directed to additional printing area and cannot be returned to its original configuration once opened. There are also known in the art cartons having fifth panels for supporting the cartons from displays or for use as closure flaps once the cartons have been initially opened by means of removable tear strips or the like.

SUMMARY OF THE INVENTION

The present invention is directed to a carton for packaging articles wherein the outer surface areas of the carton provide substantially more printing space for instructions, consumer information, or regulatory warnings. A further object of the present invention is to provide such a carton whereby a prospective purchaser can access and view instructions, information, and warnings without destructively altering the carton.

Accordingly, one aspect of the present invention is to provide a carton for packaging articles that includes coated panels in addition to the coated side walls such that printing, images, or other indicia may be printed on each of the outer surfaces and the additional panels. Desirably, all outer surfaces, as well as the additional panels, are coated with a water-soluble silicon based coating suitable for printing thereon and sufficiently heat resistant to withstand printing and hot glue adhesion. One such coating is manufactured by Kelstar Enterprises, Inc. as Item ACC222. Closure panels are attached at each end of the carton front and rear panels for securing the contents within the carton. These panels are folded inwardly and sealed one atop the other with a suitable releasable adhesive. Alternatively, the closure panels on at least one end of the carton may be sealed with a reclosable adhesive such as a hot melt adhesive, permitting repetitive opening and resealing of the ends of the container. Such adhesives are available from Henkel Adhesives Corporation as Item 80-8512 or from National Starch and Chemical Company as Item 34-2602. In the preferred embodiment, closure tabs attached at the ends of each side panel can be folded inwardly to partially close each end of the carton. The two end closure panels of substantially the same size and shape are then folded and adhered one upon the other to seal closed each end of the carton.

To provide additional printing surface area, at least one extended exterior panel is connected to an edge of one of the carton side walls. At least one of the surfaces of this extended panel is coated for printing. The extended panel can be formed of two or more individual panels that are connected together in series and folded and adhered one upon the other with the outer surfaces coated to receive additional print media thereon. The extended panel so formed can be folded over and releasably adhered to the adjacent carton front wall when the carton is being shipped, stored, or displayed for sale to consumers. A releasable adhesive is used to adhere the extended panel to an adjacent carton wall such that the panel can be easily released without destroying the carton material or any printing on the carton. Adhesives such as those described above would be suitable for such application. Desirably, the extended panel of the present invention if formed from two connected panels that are attached in hinge-like fashion to each other and to the edge of an outer wall panel. The two panels are folded one upon the other to form a single extended panel of substantially the same size and shape as the adjacent wall panels. Once formed, the extended panel is releasably adhered to one of the adjacent wall panels. In the preferred embodiment, the extended panel is releasably adhered to permit repetitive opening and resealing.

A second aspect of the present invention is to provide a carton for packaging articles that includes side walls having coated outer surfaces such that printing, images, or other indicia may be printed on each of the outer surfaces. Desirably, the outer surfaces are coated with a water-soluble silicon based coating suitable for printing thereon and sufficiently heat resistant to withstand printing and hot glue adhesion. Closure tabs are attached at the ends of each side panel and are folded inwardly to partially close each end of the carton. A single end closure panel with an attached tuck flap is attached to at least one end of the front or rear wall panel. The tuck flap is inserted adjacent the inner surface of a front or rear wall panel. As in the previous aspect, additional printing surface area is provided by at least one extended exterior panel that is connected to an edge of one of the carton side walls. The various features and refinements mentioned above in the first aspect for the extended panel may also be used with this second aspect. At least one of the surfaces of this extended panel is coated for printing.

Another aspect of the present invention is to provide a carton blank for folding into a carton and having a plurality of adjacent panels which form a front wall, rear wall, two side walls, an extended exterior panel, and end closure panels. The blank is comprised of multiple rectangular panels, all of which have substantially the same width but varying lengths. A coating is conventionally provided on one surface of the blank for printing, images, or other indicia. The box is so folded that the coated side forms the exterior of the box and the uncoated side forms the interior of the box. One of the rectangular panels forms a front wall having front and rear edges defined by the long sides of the panel. Connected to the front wall along a fold line is the rectangular panel forming a side wall and having an upper and lower edge. A third rectangular panel, connected along a fold line to the lower edge of the side panel, forms the rear wall. A fourth rectangular panel connected along a fold line to the front edge of the rear wall, forms a second side wall. A fifth and sixth panel of the same size and connected along fold lines, is connected to the upper edge of the second side panel along a fold line. One of the two panels is provided with an adhesive coating on the inner surface, whereby, when folded together along the fold line between the fourth and fifth panels, the inner surfaces of the two adjacent panels are secured together. Alternately, the fifth, or extended, panel can be formed by more than two panels connected along fold lines. In such a case, the connected panels can be folded and adhered successively one upon the other in accordion fashion, with the folded panel finally being folded over and adhered to an adjacent carton wall panel. The carton blank also comprises end closure flaps that are connected along fold lines to the end edges of the front, rear, and side walls.

These and other aspects of the present invention will become apparent to those skilled in the art after a reading of the following description of the preferred embodiment when considered with the drawings.

DESCRIPTION OF THE PREFERRED EMBODIMENTS

Figure 1:
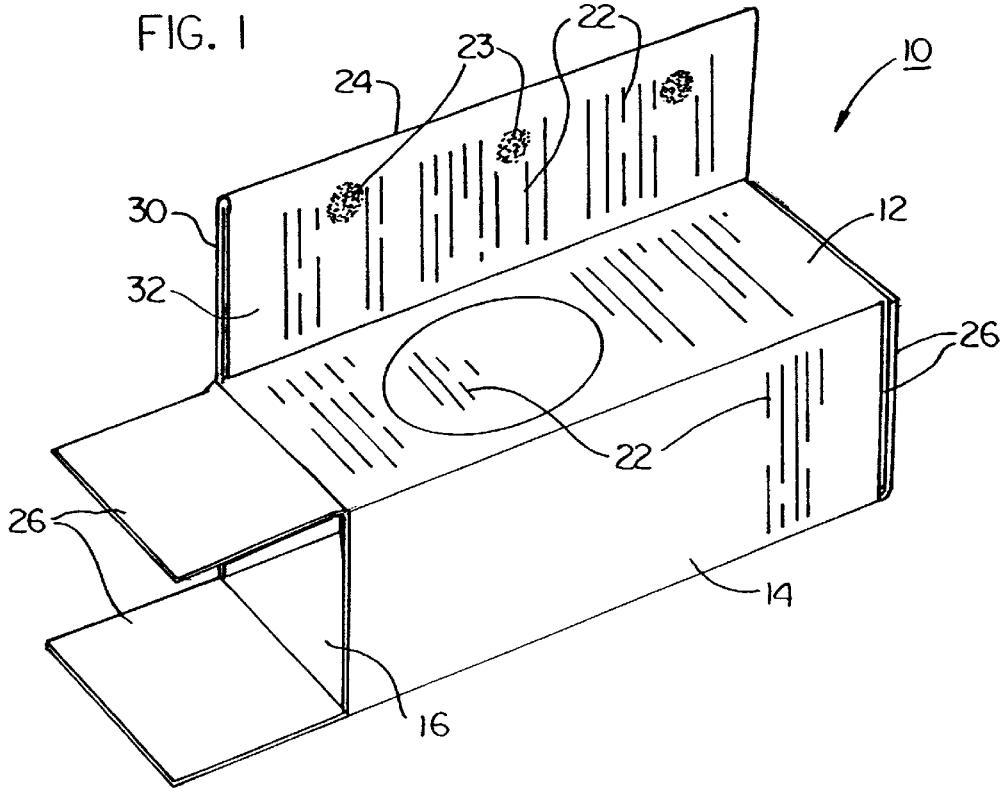
FIG. 1 is a front perspective view of a carton constructed according to the present invention, with the extended panel in the open position.
Figure 3:
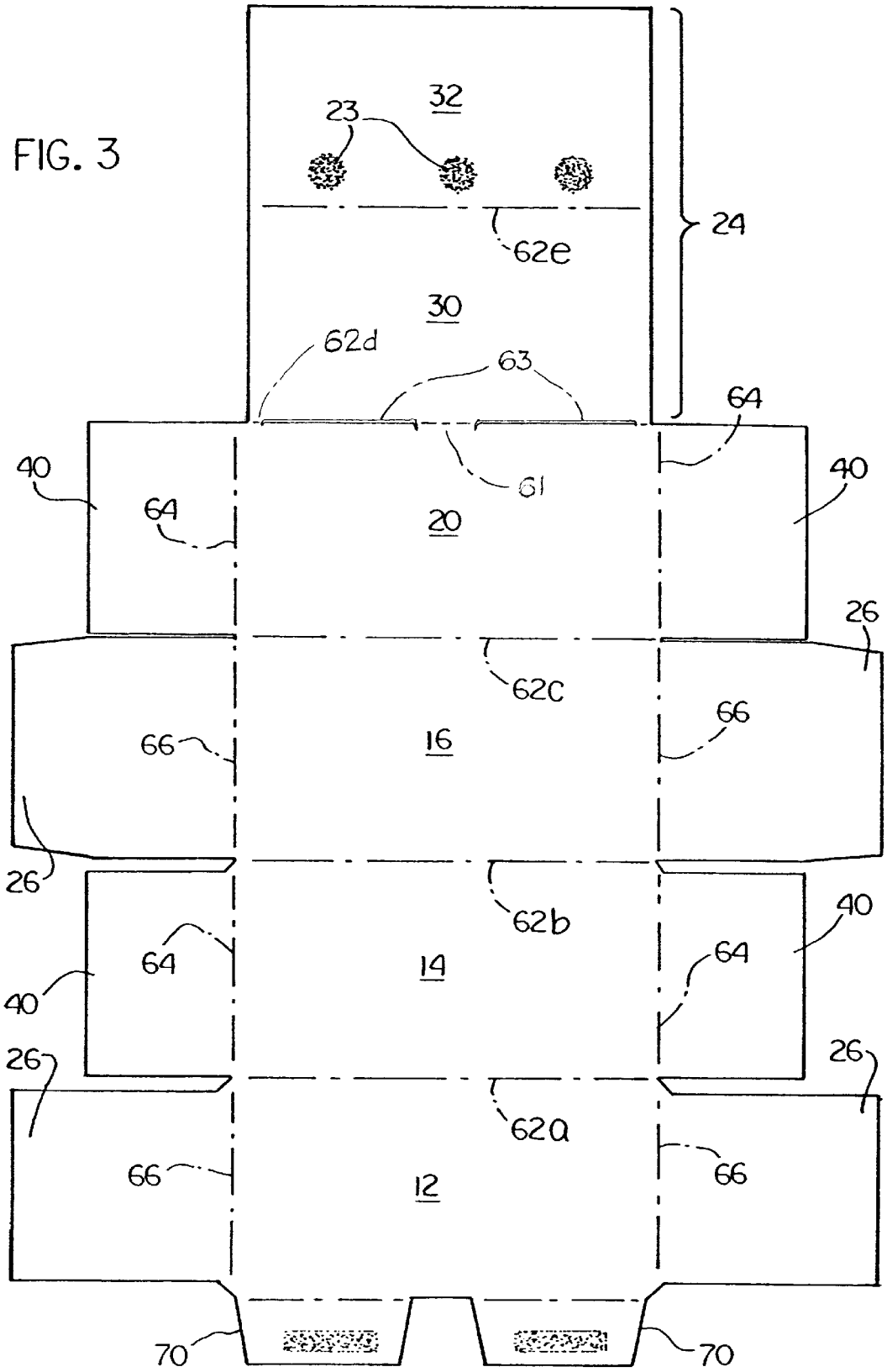
FIG. 3 is a plan view of a blank foldable sheet material from which a carton constructed according to the present invention may be formed.

Referring now to the drawings in general and FIG. 1 in particular, it will be understood that the illustrations are for the purpose of describing a preferred embodiment of the invention and are not intended to limit the invention thereto. As best seen in FIGS. 1 and 3, a carton constructed according to the present invention, generally designated 10, includes a front wall 12, rear wall 16, and two sides walls 14, 20, all hingedly connected along fold lines. The carton 10 may be formed from a unitary blank of foldable sheet material such as paperboard where the weight of the paperboard used in the construction of carton 10 is dependent upon the weight of the articles being packaged. Desirably, one complete surface of the sheet material is coated such that printing, images, and other indicia 22 may be applied thereto. The coating is conventionally a water-soluble silicon based material or other coating material that is suitable for printing thereon and sufficiently heat resistant to withstand printing and hot glue adhesion. One such coating is manufactured by Kelstar Enterprises, Inc. as Item ACC222.

Turning now to FIGS. 1 and 3, the preferred embodiment of carton 10 includes end closure panels 26 of substantially the same size and shape hingedly connected to the ends of front wall 12 and rear wall 16. Upon placing an article in the carton 10, end closure panels 26 may be folded down one upon the other and sealed closed with any suitable form of adhesive. Where repetitive opening and closing of the carton is desired, any suitable releasable adhesive may be selected therefor. Such adhesives are available from Henkel Adhesives Corporation as Item 80-8512 or from National Starch and Chemical Company as Item 34-2602.

Figure 2:
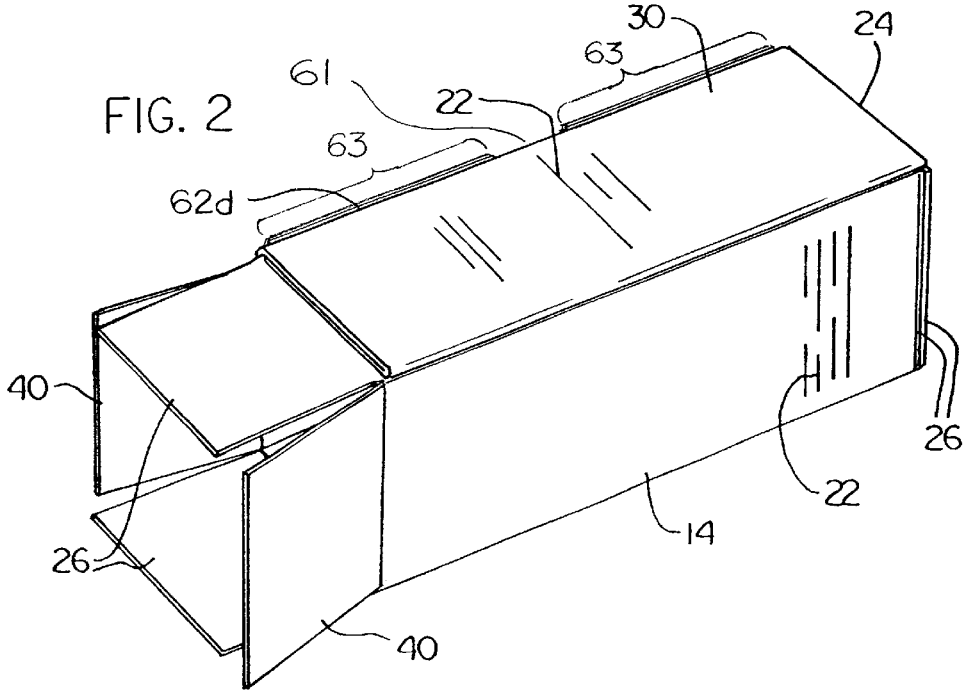
FIG. 2 is a front perspective view similar to FIG. 1 except illustrating the extended panel in the sealed position.

As best seen in FIGS. 2 and 3, it may be desirable, depending upon the article to be packaged, to employ closure tabs 40 in addition to end closure panels 26. The closure tabs 40 are substantially the same size and may be hingedly connected to the ends of side wall panels 14 and 16. Closure tabs 40 are folded inward over the end opening of carton 10 before end closure panels 26 are folded inward and sealed. Alternatively, a single end closure panel and closure tab could be used to close at least one end of carton 10.

The configuration of walls 12, 14, 16, and 20 and closure end flaps 26, 40 is conventional. The present invention adds to the above construction an extended panel 24 that is hingedly connected to side wall 20 along fold line 62*d*. As best seen in FIGS. 1 and 2, extended panel 24 is formed by folding and sealing together panels 30 and 32 such that the outer surfaces of extended panel 24 are coated. Extended panel 24 is then folded downward and releasably sealed, using adhesives as described above, to the adjacent front wall 12 using removable adhesive beads 23 that the consumer can rub off, if desired, after opening the extended panel 24. In the preferred embodiment, extended panel 24 is reclosably adherable to front wall 12, thus permitting repetitive opening and sealing of extended panel 24. As an alternative to this extended panel construction, extended panel 24 may be constructed of a plurality of rectangular panels that may be folded down and sealed one upon the other in accordion fashion (See FIG. 4).

Turning now to FIG. 3, the blank forming a carton constructed to the present invention is shown. As can be seen, the blank is in the form of a single planar unitary sheet of cardboard or paper board in which one surface is coated and printed. The main body of the carton is formed from six substantially rectangular panels 12, 14, 16, 20, 30, and 32. These panels are linked to each other by means of horizontal folding lines 62*a*, 62*b*, 62*c*, 62*d*, and 62*e* which facilitate folding of the carton panels relative to each other. Each of panels 12, 14, 16, and 18 is provided with a pair of closure tabs 40 or end closure panels 26 connected along respective transverse edges by means of corresponding score lines 64 or 66.

In forming a carton from the blank according to the present invention, front wall 12 and first side wall 14 are formed by folding rectangular panels along fold line 62*a*, creating edge 44. Likewise, rear wall 16 and second side wall 20 are formed by folding the blank panels along fold lines 62*b* and 62*c*, creating edges 50 and 52. Closure of the carton is accomplished by folding inward and securing glue tabs 70, hingedly connected to front wall 12, creating edge 46.

Extended panel 24 is formed of two adjacent panels 30 and 32 that are hingedly connected together and extend upward from second side wall edge 46. Panels 30 and 32 are folded one upon the other along fold line 62*e* such that the coated surfaces are outwardly exposed. Panels 30 and 32 may be adhered together with glue or any suitable adhesive material. Once formed, extended panel 24 is folded downward and reclosably adhered to front wall panel 12 as shown in FIG. 2.

Figure 4:
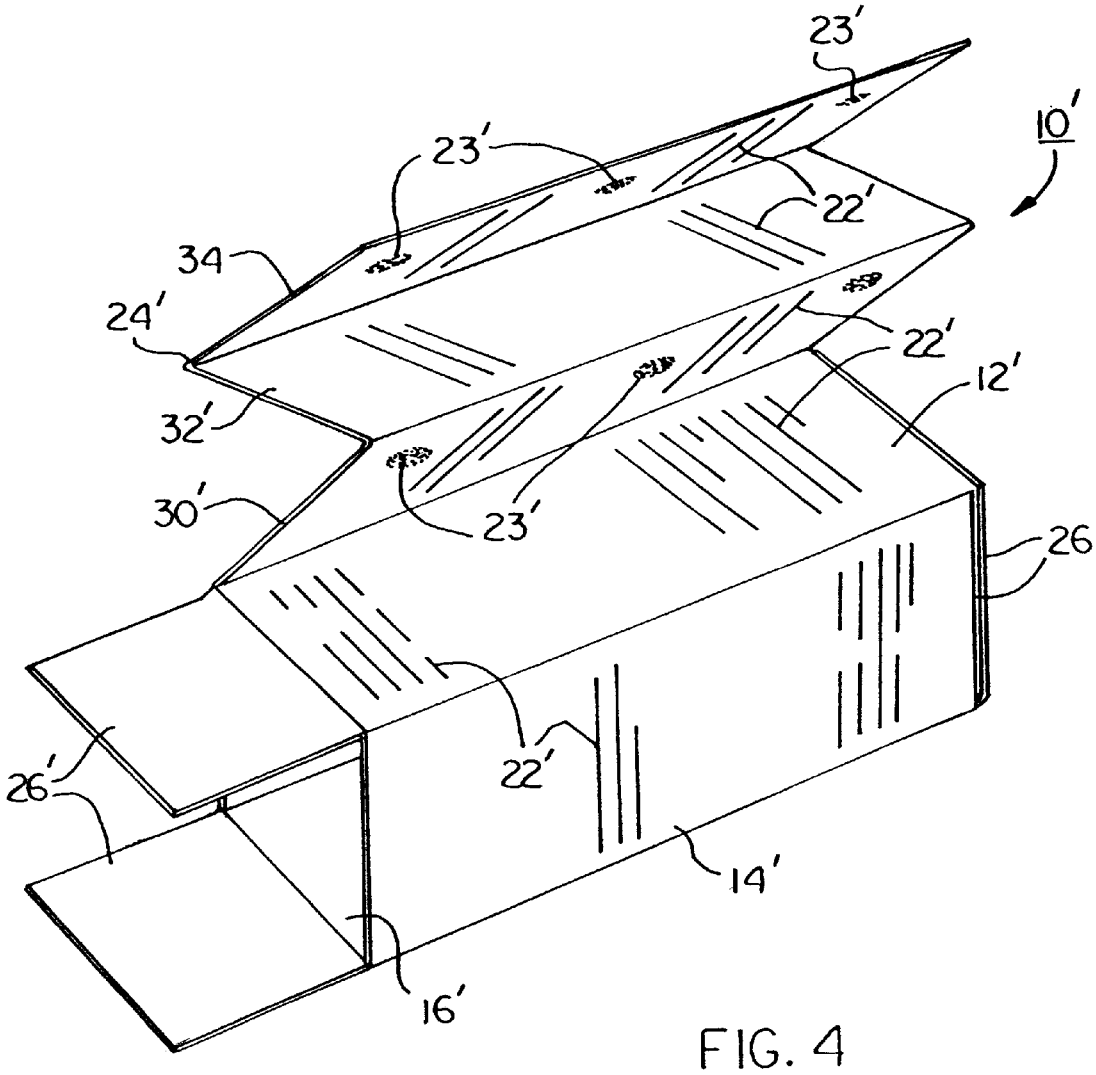
FIG. 4 is a front perspective view of a carton construction according to the present invention having an extended panel formed in accordion style.

As shown in FIGS. 2 and 3, at least one elongated slit 63 is preferably provided at the juncture between wall 20 and panel 30 along fold line 62*d*. Preferably, two colinear slits 63 are provided as shown, such that a ligament of foldable sheet material 61 exists between the two slits. The two slits 63 are preferably located along fold line 62*d* such that the slits coincide in position with glue tabs 70 when the carton is assembled and glue tabs 70 are adhered to side wall 20. Ligament 61 coincides in position to the space between glue tabs 70. The slit or slits 63 are provided to increase the flexibility of the hinged connection between wall 20 and panel 30 along fold line 62*d*. Without slits 63, the corner at fold line 62*d* would have a higher resilience than the other three corners of the assembled carton. Such greater resilience or "memory" at this corner would result from the additional stiffness and resilience provided by glue tabs 70 when the carton is assembled and glue tabs 70 are adhered to side wall 20 adjacent to fold line 62*d*. Such asymmetrical resilience between the corners acts to partially close or skew the carton from its square shape when at least one end of the carton is open. Such skewing of the carton is particularly undesirable while the open carton is being filled with a product, especially when the carton is being filled by automated filling equipment. Slit or slits 63 compensate for this higher potential resilience so that the resiliencies along all four corners of the carton are substantially equal. As a result, the corners of the carton tend to remain substantially square when the carton is assembled and one end of the carton is open as shown in FIG. 2 or FIG. 4.

Figure 5:
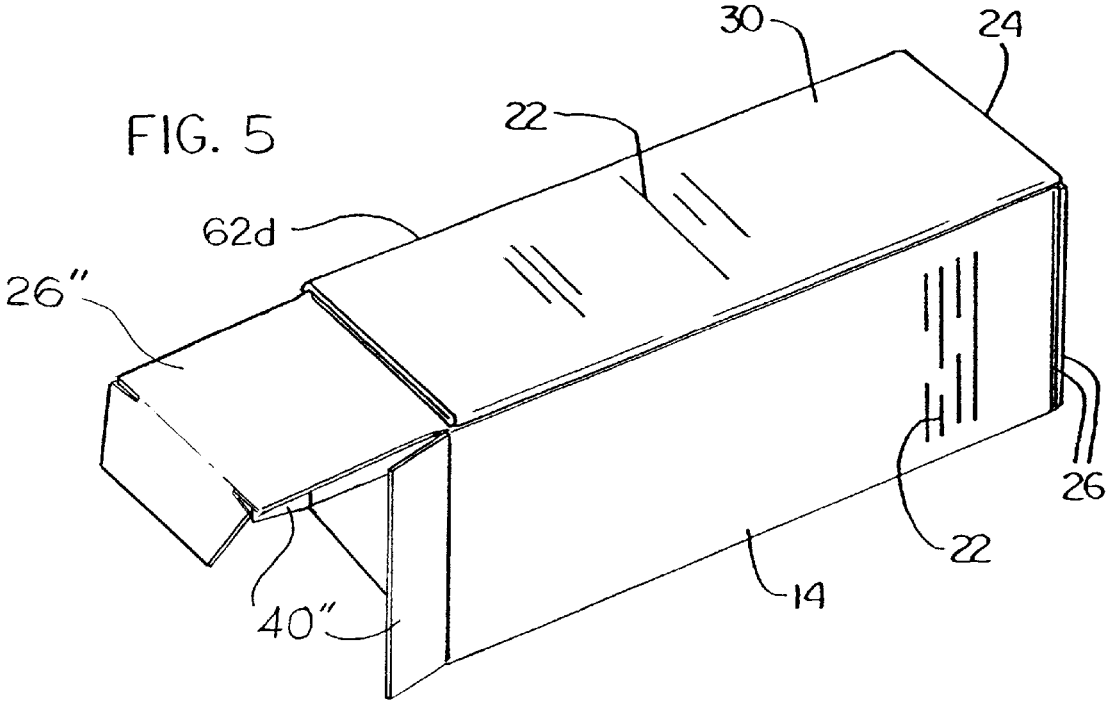
FIG. 5 is a front perspective view of a carton similar to that of FIG. 2, having a tuck-in flap arrangement.

Closure of carton 10 is achieved by first folding inwardly closure tabs 40 along fold lines 64. End closure panels 26 are then folded inward along fold lines 66. End closure panels 26 are then releasably adhered one upon the other. In the alternative, the end closure panels 26 on at least one end of the carton 10 may be reclosably adhered, thus permitting repetitive opening and sealing of carton 10. Still further as shown in FIG. 5, the carton may include a single end closure panel 26" having a tuck-in flap, and a pair of shorter closure tabs 40" which provide a reclosable, "tuck-in" closure arrangement.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A carton for packaging articles, said carton comprising:

(a) a plurality of wall panels having coated outer surfaces for printing thereon;

(b) end closure panels hingedly connected to at least some of the wall panels, wherein said wall panels and said end closure panels combine to form a carton enclosure;

(c) at least one extended panel being of substantially the same size and same shape as one of said wall panels, said at least one extended panel hingedly connected to one of said wall panels and extending from an outside edge of said carton enclosure, and having at least one coated print receptive outer surface; and (d) an adhesive disposed on said at least one extended panel to reclosably adhere said extended panel to one of the adjacent side wall panels having substantially the same size and same shape as said at least one extended panel.

2. The carton of claim 1 wherein said at least one extended panel is comprised of two wall sized panels hingedly connected together and permanently adhered one upon the other.

3. The carton of claim 2 wherein both of said hingedly connected panels have print receptive coated outer surfaces.

4. The carton of claim 1 wherein more than two wall sized panels are folded one upon the other in an accordion style such that said at least one additional extended panel is of substantially the same size and same shape as said one of the adjacent side wall panels when so folded.

5. A blank for folding into a carton, said blank having a first surface and a second surface, comprising:

(a) a plurality of rectangular wall panels, all of which have substantially the same size and shape and which are hingedly connected together along side edges, said panels having end edges;

(b) at least one extended panel formed of at least two adjacent wall-sized panels extending from an outer side edge of one rectangular wall panel and being outwardly extendable from said carton;

(i) the lowermost of said two adjacent wall-sized panels of said extended panel being substantially the same size and shape as said rectangular wall panels and having a lower edge and an upper edge, wherein the lower edge is hingedly connected to the side edge of the rectangular panel;

(ii) the uppermost of said two adjacent wall-sized panels of said additional exterior panel being substantially the same size and shape as said rectangular wall panels and having a lower edge and an upper edge, wherein the lower edge is hingedly connected to the upper edge of the lowermost panel;

(c) the end edges of at least some of the rectangular wall panels having end flaps hingedly connected thereto;

(d) a coating on at least one of said first and second surfaces for printing thereon;

(e) a releasable adhesive applied to at least one of said adjacent panels of said extended panel or to the adjacent one of said rectangular wall panels; and;

(f) wherein when said blank is formed into a carton said extended panel is reclosably adhered to said adjacent wall panel.

* * * * *